US005537962A

United States Patent [19]

Fukuzawa et al.

[11] Patent Number: 5,537,962

[45] Date of Patent: Jul. 23, 1996

[54] VALVE OPERATING APPARATUS FOR INTERNAL COMBUSTION ENGINE

[75] Inventors: Masami Fukuzawa; Kazuhide Kumagai, both of Saitama-ken, Japan

[73] Assignee: Honda Giken Kogyo Kabushiki Kaisha, Tokyo, Japan

[21] Appl. No.: 428,555

[22] Filed: Apr. 25, 1995

[30] Foreign Application Priority Data

Jun. 15, 1994 [JP] Japan ..... 6-133334

[51] Int. Cl.[6] ..... F01L 13/00

[52] U.S. Cl. ..... 123/90.16; 123/90.44

[58] Field of Search ..... 123/90.15, 90.16, 123/90.17, 90.22, 90.27, 90.39, 90.44, 90.65

[56] References Cited

U.S. PATENT DOCUMENTS

| | | | |
|---|---|---|---|
| 2,100,057 | 11/1937 | Krebs | 123/90 |
| 4,354,460 | 10/1982 | Mae et al. | 123/90.16 |
| 4,448,156 | 5/1984 | Henault | 123/90.17 |
| 4,787,346 | 11/1988 | Ajiki et al. | 123/90.44 |
| 4,957,076 | 9/1990 | Inoue et al. | 123/90.16 |
| 4,970,997 | 11/1990 | Inoue et al. | 123/90.16 |
| 5,239,952 | 8/1993 | Morita | 123/90.16 |
| 5,273,006 | 12/1993 | Schapertons et al. | 123/90.16 |

FOREIGN PATENT DOCUMENTS

| | | |
|---|---|---|
| 524314A1 | 1/1993 | European Pat. Off. . |
| 1120804 | 9/1959 | Germany . |

*Primary Examiner*—Weilun Lo
*Attorney, Agent, or Firm*—Lyon & Lyon

[57] ABSTRACT

A valve operating apparatus for driving intake valves and exhaust valves of an internal combustion engine has a valve operating cam and a rocker arm unit. The rocker arm unit is made up of driving rocker arms which operatively contact the valves, a free rocker arm which is free from contact with the valves, and a changeover mechanism for varying the valve lift amount and timing of opening and closing the valves by connecting the rocker arms and releasing the connection between them. The free rocker arm is urged by a torsion spring so as to operatively contact the valve operating cam. The torsion spring is disposed inside a hollow rocker arm shaft of the rocker arm unit. In case the free rocker arm is fixed to the rocker arm shaft, a coil spring is disposed inside a supporting portion for rotatably supporting the rocker arm shaft such that the free rocker arm is urged by the coil spring via the rocker arm shaft.

8 Claims, 8 Drawing Sheets

VALVE OPERATING APPARATUS FOR INTERNAL COMBUSTION ENGINE

BACKGROUND OF THE INVENTION

1. Field of the Invention

The present invention relates to a valve operating apparatus for operating intake (or inlet) valves and/or exhaust valves of an internal combustion engine, the valve operating apparatus comprising valve-operating cams and rocker arm units. The present invention relates, in particular, to a valve operating apparatus in which each of the rocker arm units is made up of driving rocker arms which operatively contact valves, a free rocker arm which is free from operating contact with, or does not operatively contact, the valves, and a changeover mechanism which varies the valve lift amount and the timing of opening and closing the valves by connecting the rocker arms and releasing their connection.

2. Description of Related Art

In this kind of valve operating apparatus, when the connection between the free rocker arm and the driving rocker arms is released, an urging force of a valve spring will no longer function or operate on the free rocker arm. Therefore, it is necessary to provide an urging means to urge the free rocker arm into operating contact with a valve driving cam.

Conventionally, as shown in FIG. 16, a bridge member c is provided between cam holders b which support rocker arm shafts "a" of rocker arm units, and an urging means d which comprises a piston $d_2$ to be urged by a spring $d_1$ is mounted on the bridge member c such that the piston $d_2$ operatively contacts a free rocker arm e, wherein the free rocker arm e is urged towards the valve driving cam f (see Japanese Published Unexamined Patent Application No. 1405/1992). Alternatively, as shown in FIG. 17, the urging means d having a similar construction as described above is mounted on a boss portion g which is provided in a projecting manner on a cylinder head, such that the piston $d_2$ operatively contacts the free rocker arm e, whereby the free rocker arm e is urged towards the valve driving cam f.

The conventional example shown in FIG. 16 has the following disadvantages. Namely, the bridge member c for mounting thereon the urging means d becomes necessary, resulting in an increase in weight and cost. Further, a space for disposing the urging means d must be provided above the rocker arm unit, resulting in an increase in height of the engine.

The conventional example shown in FIG. 17 also has the following disadvantages. Namely, the boss portion g for mounting thereon the urging means d must be provided in a projecting manner on the cylinder head, resulting in an increase in the weight. Further, a space for disposing the urging means d must be provided between the adjoining valves, resulting in a limitation, or a restriction, in the freedom in the design of the valve layout.

In any of the above-described conventional examples, there is a further disadvantage in that the construction of the urging means d becomes complicated, resulting in a higher cost.

SUMMARY OF THE INVENTION

In view of the above disadvantages, the present invention has an object of providing a light and inexpensive valve operating apparatus which can be disposed at a high space efficiency without the need for an exclusive member with which the urging means is mounted and which can also simplify the construction of the urging means.

In order to attain the above and other objects, according to a first feature of the present invention, there is provided a valve operating apparatus for driving an intake valve or an exhaust valve of an internal combustion engine. The valve operating apparatus has a valve operating cam and a rocker arm unit. The rocker arm unit comprises a driving rocker arm which operatively contacts the valve, a free rocker arm which is free from operative contact with the valve, and a changeover mechanism for varying a valve lift amount and timing of opening and closing the valve by connecting both the rocker arms and releasing the connection therebetween. The free rocker arm is urged by urging means so as to operatively contact the valve operating cam. The urging means is disposed inside a hollow rocker arm shaft of the rocker arm unit.

According to a second feature of the present invention, a free rocker arm is fixed to the rocker arm shaft of the rocker arm unit, and an urging means is disposed inside a supporting portion for rotatably supporting the rocker arm shaft such that the free rocker arm is urged by the urging means via the rocker arm shaft.

Since the urging means is disposed inside the rocker arm shaft or inside the supporting portion of the rocker arm shaft, it is not necessary to provide a space for disposing the urging means outside the rocker arm shaft. The height of the engine can therefore be reduced and the freedom of design in laying out the valves is increased. Further, a mounting member for the urging means becomes needless, with the result that the decrease in the weight and the cost can be attained.

Further, by disposing the urging means inside the rocker arm shaft, the rocker arm unit can be sub-assembled in a condition in which the urging means is assembled therein. The ease with which the valve operating apparatus can be assembled, or the workability, is improved. In these arrangements, in case the free rocker arm is fixed to the rocker arm shaft, the urging means may be made by a torsion spring which is connected to the rocker arm shaft. In case the free rocker arm is rotatably supported by the rocker arm shaft, the urging means may be constituted by a torsion spring which is connected to the free rocker arm through a radial opening formed in the rocker arm shaft. In any case, the construction of the urging means can be simplified and the cost thereof can be reduced.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
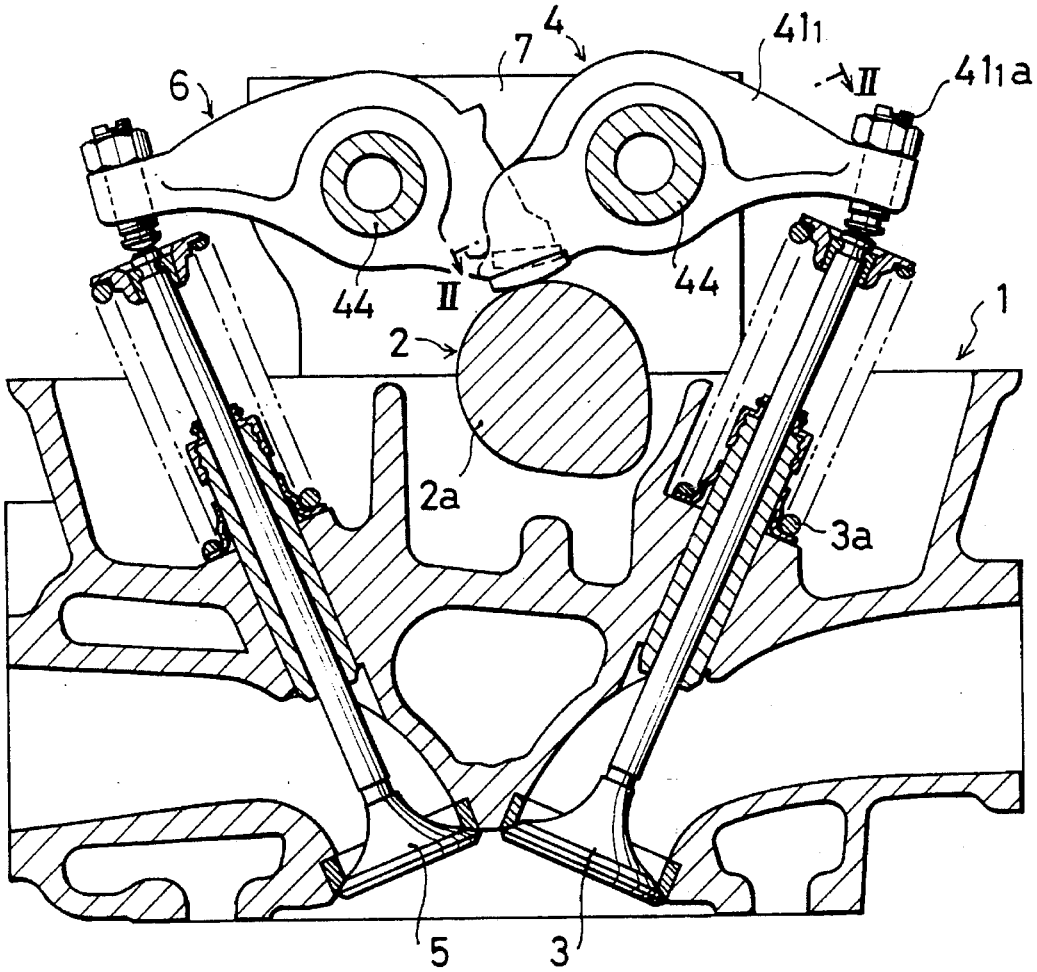
FIG. 1 is a sectional side view of one embodying example of a cylinder head which is provided with an apparatus according to the present invention.

With reference to FIG. 1, numeral 1 denotes a cylinder head for an internal combustion engine. On the cylinder head 1 there are provided a valve driving cam 2, a rocker arm unit 4 for intake (or inlet) valves 3, and a rocker arm unit 6 for exhaust valves 5.

The intake valves 3 are provided in a pair. The rocker arm unit 4 is made up of a pair of first and second driving rocker arms $41_1$, $41_2$ which operatively contact respective intake valves 3, an intermediate free rocker arm 42 which does not operatively contact, or free from operative contact with, the intake valves 3, and a changeover mechanism 43 which connects the free rocker arm 42 and both the driving rocker arms $41_1$, $41_2$ and releases the connection therebetween. Both the driving rocker arms $41_1$, $41_2$ are supported in a swingable manner on a rocker arm shaft 44 which is rotatably supported between cam holders 7, 7 on the cylinder head 1. Each of the rocker arms $41_1$, $41_2$ is made to contact each of the intake valves 3 via an adjusting screw $41_1a$, $41_2a$ which is mounted on one end of each rocker arm, and the other end of the rocker arm is made to contact a low-speed cam portion 2*a* of the valve driving cam 2. The free rocker arm 42 is formed integrally with the rocker arm shaft 44, and its end portion is made to contact a high-speed cam portion 2*b* of the valve driving cam 2.

The changeover mechanism 43 is made up of: a first connecting pin 43*a* which is inserted into the first driving rocker arm $41_1$ and which can be engaged with, and disengaged from, the free rocker arm 42; a second connecting pin 43*b* which is inserted into the free rocker arm 42 and which can be engaged with, and disengaged from, the second driving rocker arm $41_2$; a restricting pin 43*d* which is inserted into the second driving rocker arm 412 and which is urged by a spring 43*c* towards the free rocker arm 42; and an oil chamber 43*e* which is formed in the first driving rocker arm $41_1$ and which, when pressurized with oil, urges the first connecting pin 43*a* towards the free rocker arm 42.

An arrangement has thus been made as follows. Namely, when the oil pressure to be inputted from an oil passage 43*f* formed in the cam holder 7 to the oil chamber 43*e* through the inside of the rocker arm shaft 44 is increased, the first connecting pin 43*a* is engaged with the free rocker arm 42 and, also, the second connecting pin 43*b* is engaged with the second driving rocker arm $41_2$ as a result of a push by the first connecting pin 43*a*, whereby both the rocker arms $41_1$, $41_2$ and the free rocker arm 42 are connected together. In this condition, the intake valves 3 are opened and closed in a relatively large valve lift amount which is defined by the high-speed cam portion 2*b* and in a valve opening/closing timing of long valve open-period, which condition being suitable for high-speed running. When the oil pressure in the oil chamber 43*e* is decreased, the second connecting pin 43*b* and the first connecting pin 43*a* are urged back respectively into the free rocker arm 42 and the first driving rocker arm $41_1$ by means of the urging force of the spring 43*c* via the restricting pin 43*d*, whereby the connection between both the driving rocker arms $41_1$, $41_2$ and the free rocker arm 42 is released. In this condition, the intake valves 3 are opened and closed in a relatively small valve lift amount which is defined by the low-speed cam portion 2*a* and in a valve opening/closing timing of short valve-open period, which conditions being suitable for low-speed running.

Figure 3:
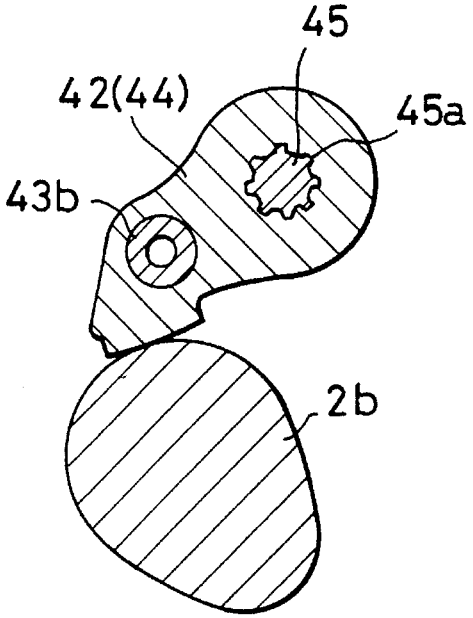
FIG. 3 is a sectional side view taken along the line III—III in FIG. 2.

When the connection between the driving rocker arms $41_1$, $41_2$ and the free rocker arm 42 is released, the free rocker arm 42 will no longer be subject to the operation or function of the urging force of a valve spring 3*a* of the intake valve 3. Therefore, a separate urging means 45 is provided to cause the free rocker arm 42 to contact the high-speed cam portion 2*b*. In this embodying example, the urging means 45 is constituted by a bar-like torsion spring, i.e., a torsion bar, which is inserted into the hollow rocker arm shaft 44. The urging means 45 has the following arrangement. Namely, both end portions of the torsion spring 45 are fixed to cam holders 7, 7 in a nonrotatable manner, and an intermediate portion of the torsion spring 45 is connected to the rocker arm shaft 44 in a nonrotatable manner. The free rocker arm 42 is thus urged in the counterclockwise direction as seen in FIG. 3 by the torsion spring 45 via the rocker arm shaft 44, whereby the end portion of the free rocker arm 42 is caused to contact the high-speed cam portion 2*b*. In this embodying example, serrated or spline portions 45*a* are provided respectively in both end portions and in the intermediate portion of the torsion spring 45 to thereby fix it to the cam holders 7, 7 and to the rocker arm shaft 44 in a nonrotatable manner. However, the torsion spring 45 may be prevented from rotating by means of a pin, a key or the like. Alternatively, the intermediate portion of the torsion spring 45 may be fixed to the rocker arm shaft 44 by means of friction welding.

By disposing the urging means 45 for the free rocker arm 42 inside the rocker arm shaft 44 in the manner as described above, there is no need to provide a space for disposing the urging means outside the free rocker arm 42. Therefore, the height of the internal combustion engine can be reduced and the freedom in the design in laying out the valves is increased. Further, since a mounting member to be used exclusively for the urging means becomes unnecessary, the weight and the cost of the internal combustion engine can be decreased. Still furthermore, the rocker arm unit 4 can be sub-assembled in a condition in which the urging means 45 is assembled therein, resulting in an improvement in the workability or the ease with which the valve operating apparatus can be assembled.

Figure 2:
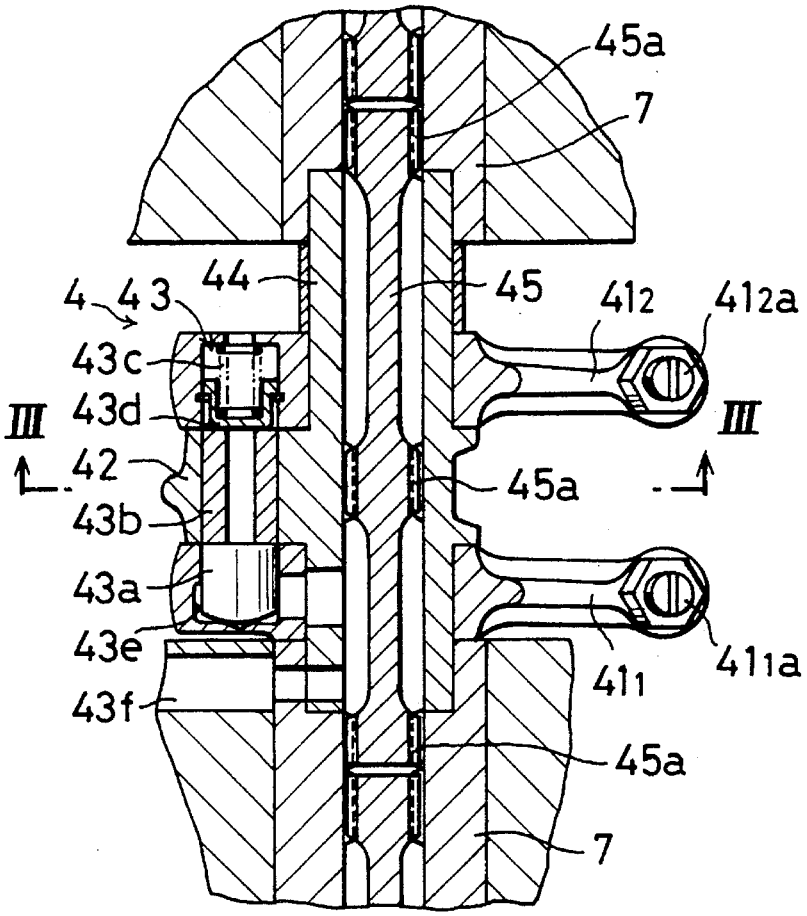
FIG. 2 is a sectional plan view taken along the line II—II in FIG. 1.
Figure 4:
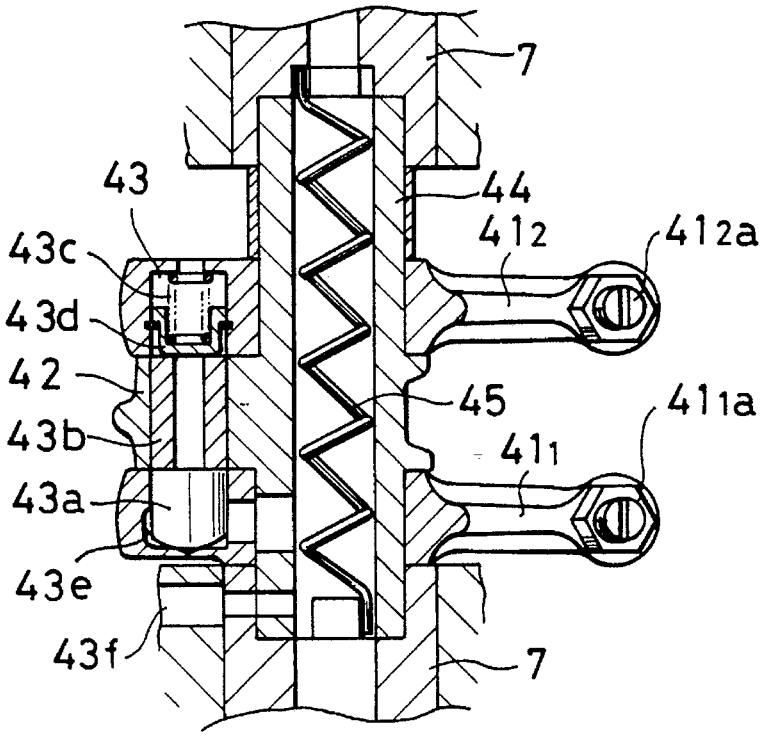
FIG. 4 is a sectional plan view of a second embodying example of the present invention.

In the above-described embodying example, the torsion bar is employed as the urging means 45. There may also be employed a torsion coil spring as the urging means 45, as shown in FIG. 4, which is connected at one end thereof to the cam holder 7 and at the other end thereof to the rocker arm shaft 44. In the embodiment of FIG. 4 and other embodiments described below, elements of the valve operating apparatus that are the same as the embodiment of FIGS. 1–3 are identified by the same numeral and will not be described again.

Figure 5:
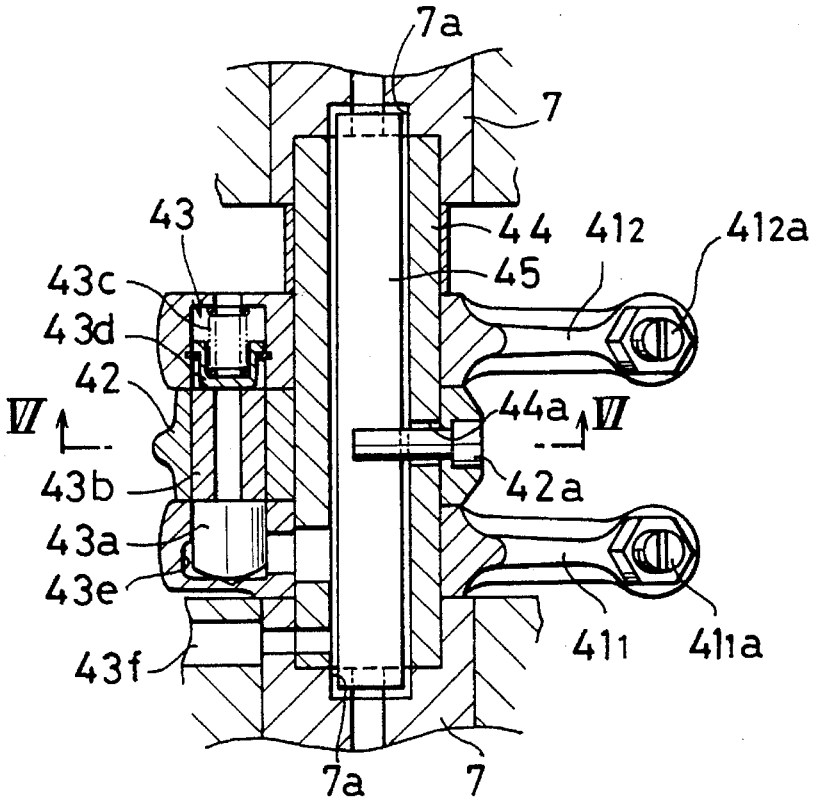
FIG. 5 is a sectional plan view of a third embodying example of the present invention.
Figure 6:
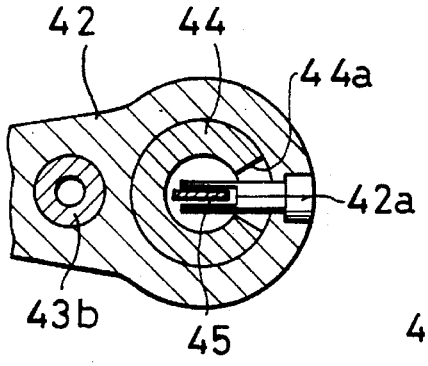
FIG. 6 is a sectional side view taken along the line VI—VI in FIG. 5.
Figure 7:
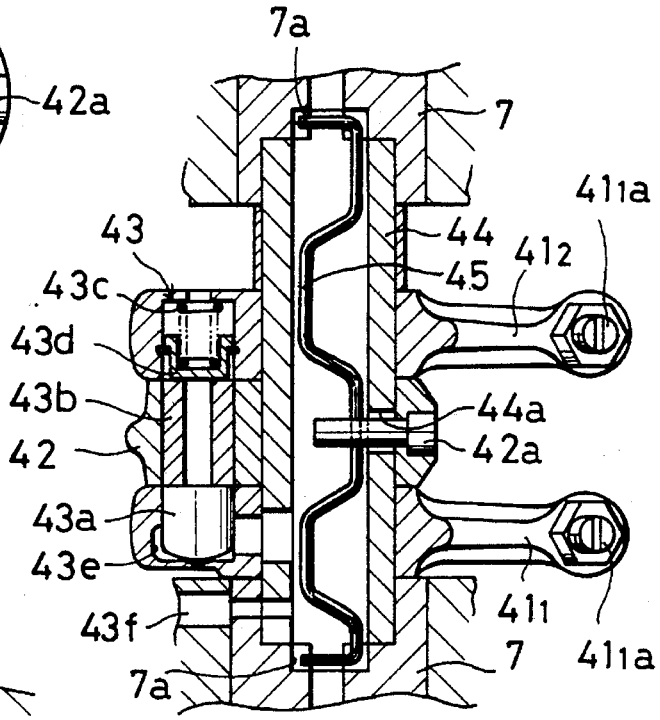
FIG. 7 is a sectional plan view of a fourth embodying example of the present invention.

In the above-described embodying examples, the free rocker arm 42 is fixed to or integral with the rocker arm shaft 44. However, in case the free rocker arm 42 is rotatably supported by the rocker arm shaft 44, the following arrangement may be employed. Namely, a radial opening 44*a* is formed in the rocker arm shaft 44 as shown in FIGS. 5 and 6. The free rocker arm 42 is then connected through the opening 44*a* to the torsion spring 45, which is disposed inside the rocker arm shaft 44, by means of a connecting member 42*a* which is mounted on the free rocker arm 42. In this embodying example, the torsion spring 45 is constituted or made by a plate spring both ends of which are engaged with grooves 7*a*, 7*a* formed in the cam holders 7, 7 in a nonrotatable manner to thereby prevent it from rotating. However, there may also be employed a torsion spring 45 which is made up of a wire rod as shown in FIG. 7.

Figure 8:
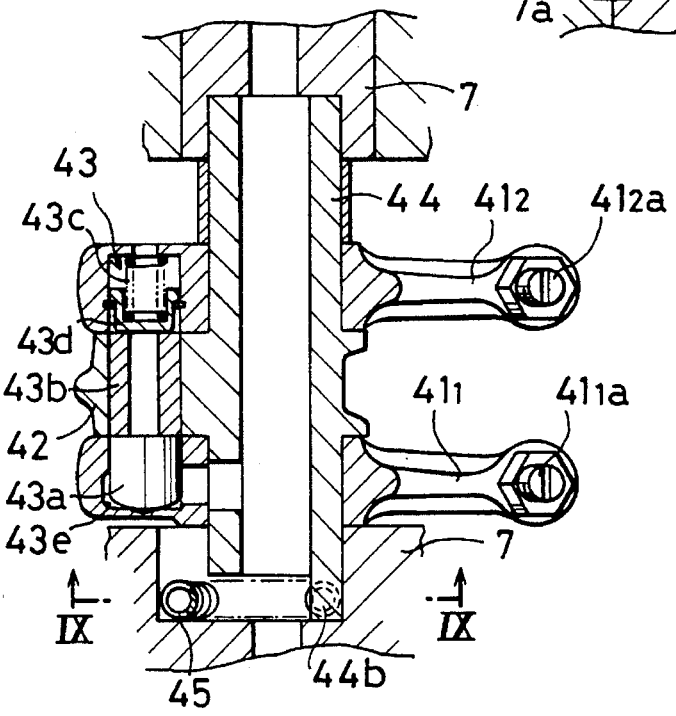
FIG. 8 is a sectional plan view of a fifth embodying example of the present invention.
Figure 9:
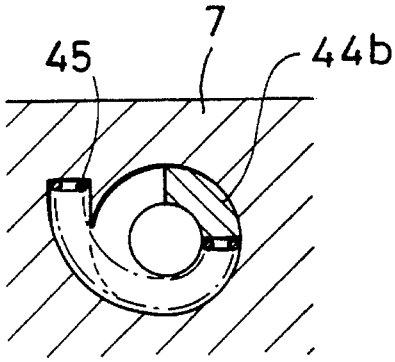
FIG. 9 is a sectional side view taken along the line IX—IX in FIG. 8.

Further, in case the free rocker arm 42 is fixed to the rocker arm shaft 44, the urging means 45 for rotatably urging the rocker arm shaft 44 may be disposed, as shown in FIGS. 8 and 9, inside the cam holder 7 which serves as the supporting portion for rotatably supporting the rocker arm shaft 44. In this embodying example, the urging means 45 is made by a coil spring one end of which is caused to contact a projecting portion 44*b* at an end of the rocker arm shaft 44. The urging means 45 may of course be made by an elastic member such as rubber or the like.

Figure 10:
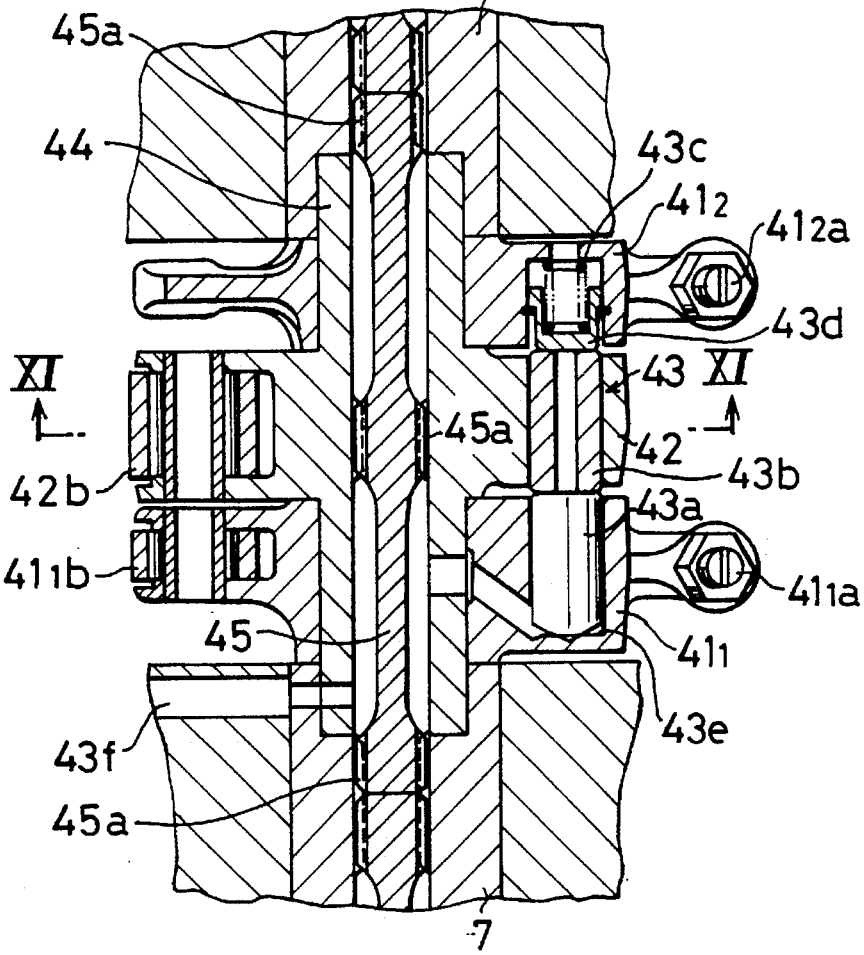
FIG. 10 s a sectional plan view of a sixth embodying example of the present invention.
Figure 11:
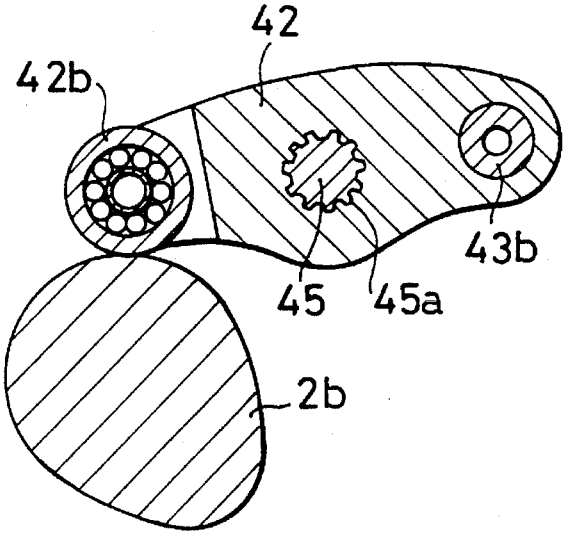
FIG. 11 is a sectional side view taken along the line XI—XI in FIG. 10.

An embodying example shown in FIGS. 10 and 11 has the following arrangement. Namely, the first driving rocker arm $\mathbf{41}_1$ is caused to contact the low-speed cam portion of the valve driving cam 2 via a roller 41*b* which is rotatably mounted on the first driving rocker arm 41. The free rocker arm 42 is caused to contact the high-speed cam portion 2*b* of the valve driving cam 2 via a roller 42*b* which is rotatably mounted on the free rocker arm 42. On the other hand, the second driving rocker arm $\mathbf{41}_2$ is caused to contact a circular shaft portion of the valve driving cam 2. When both the driving rocker arms $\mathbf{41}_1$, $\mathbf{41}_2$ and the free rocker arm 42 are connected together by means of the changeover mechanism 43, the pair of intake valves 3 are opened and closed by a valve lift amount and an opening and closing timing to be defined by the high-speed cam portion 2*b*. When this connection is released, the intake valve that corresponds to the second driving rocker arm $\mathbf{41}_2$ is held in a closed condition, and only the intake valve that corresponds to the first driving rocker arm $\mathbf{41}_1$ is opened and closed by a valve lift amount and an opening and closing timing to be defined by the low-speed cam portion 2*a*.

The free rocker arm 42 is fixed to the rocker arm shaft 44. The urging means 45 for the free rocker arm 42 is made by a torsion spring which is disposed inside the rocker arm shaft 44 in the same manner as the embodying example shown in FIG. 2. Both ends and an intermediate portion of the torsion spring 45 are respectively mounted on the cam holders 7, 7 and the rocker arm shaft 44 in a nonrotatable manner by means of serrated portions 45*a*.

Figure 12:
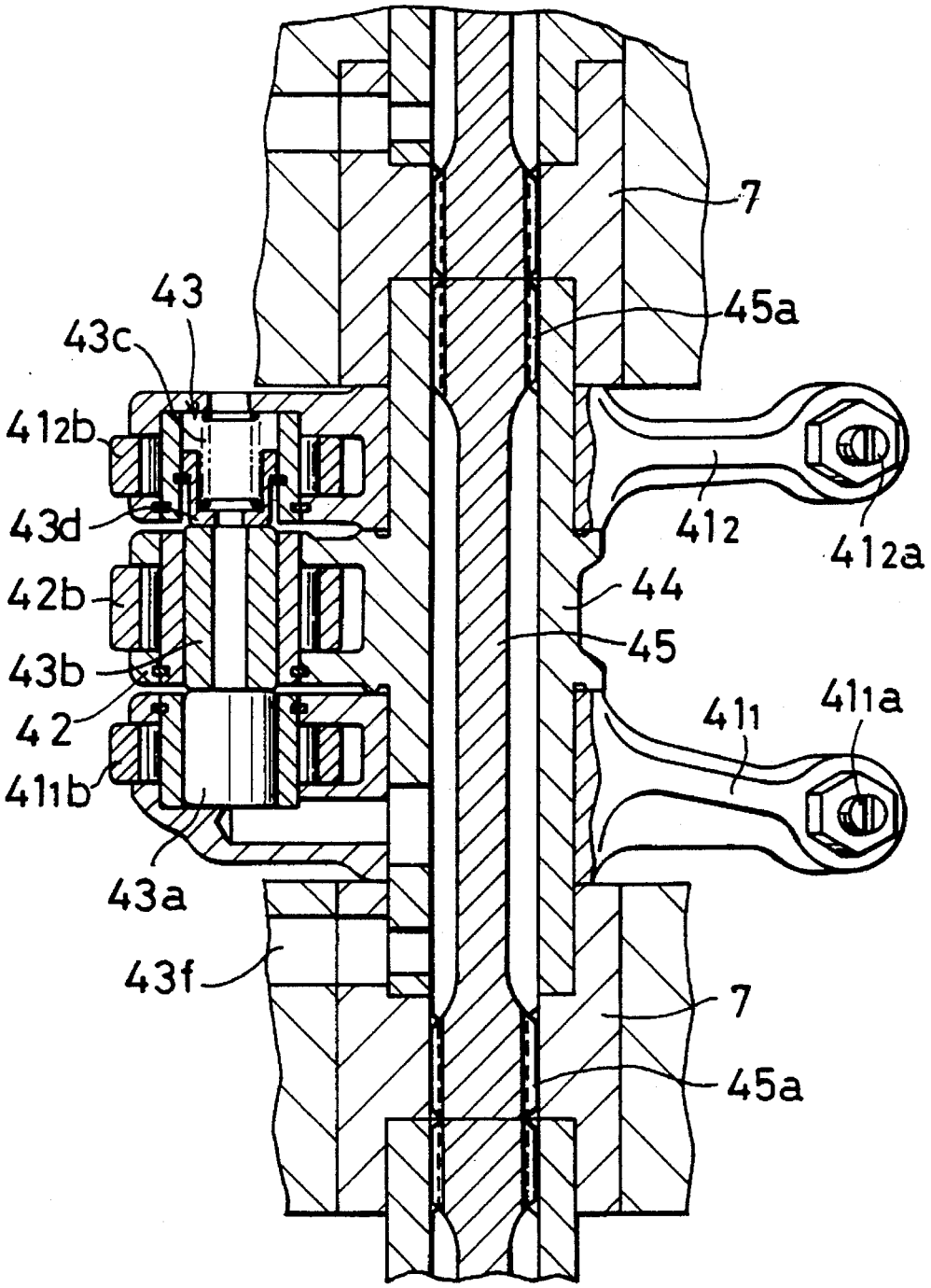
FIG. 12 is a sectional plan view of a seventh embodying example of the present invention.

An embodying example shown in FIG. 12 has the following arrangement. Namely, both the first and the second driving rocker arms $\mathbf{41}_1$, $\mathbf{41}_2$ are caused to contact the low-speed cam portion of the valve driving cam respectively via rollers $\mathbf{41}_1b$, $\mathbf{41}_2b$, and the free rocker arm 42 is caused to contact the high-speed cam portion of the valve driving cam via a roller 42*b*. Further, the first connecting pin 43*a*, the second connecting pin 43*b*, and the restricting pin 43*d* which compose or make up the changeover mechanism 43 are respectively inserted coaxially into hollow shafts supporting the rollers $\mathbf{41}_1b$, 42*b*, 41hd 2*b*.

In this embodying example, too, the free rocker arm 42 is fixed to the rocker arm shaft 44. A torsion spring 45 which serves as the urging means for the free rocker arm 42 is disposed inside the rocker arm shaft 44. This torsion spring 45 is mounted in a nonrotatable manner on the cam holder 7 and the rocker arm shaft 44 at one end and the other end, respectively, by means of serrated portions 45*a*.

Figure 13:
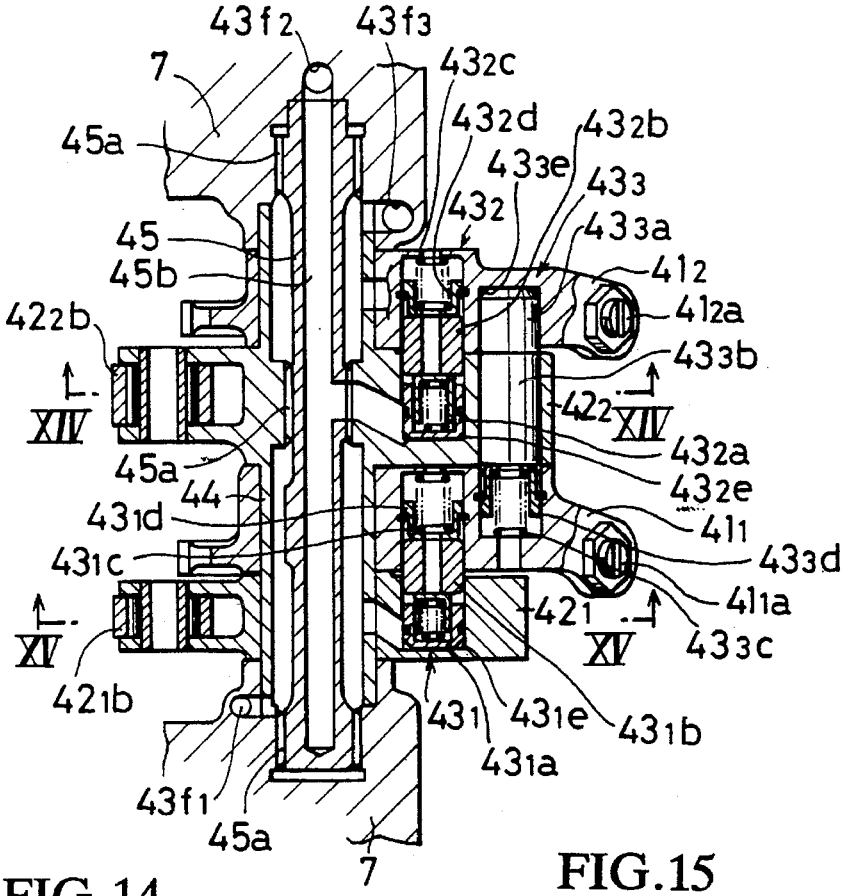
FIG. 13 is a sectional plan view of an eight embodying example of the present invention.
Figure 14:
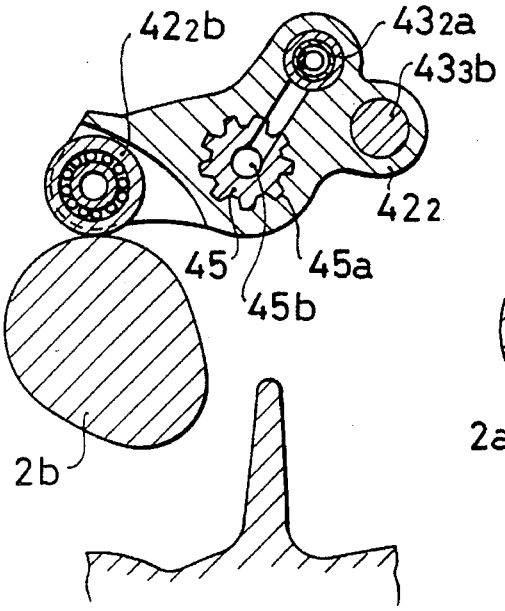
FIG. 14 is a sectional side view taken along the line XIV—XIV in FIG. 13.
Figure 15:
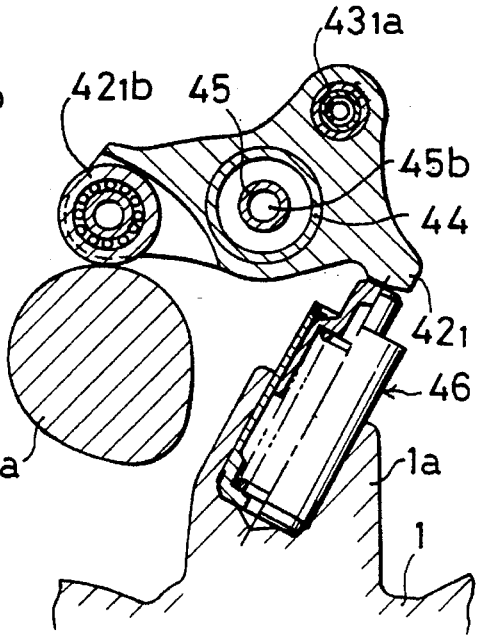
FIG. 15 s a sectional side view taken along the line XV—XV in FIG. 13.
Figure 16:
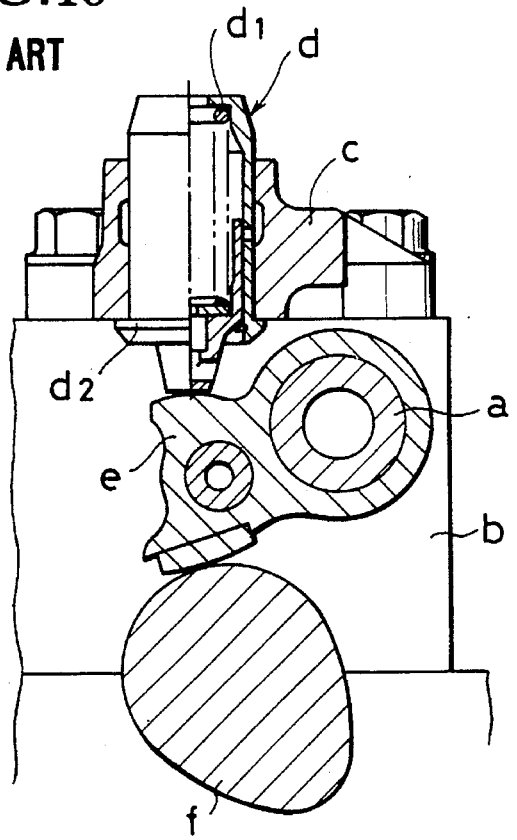
FIG.16 PRIOR ART
FIG. 16 is a sectional side view of a conventional example.
Figure 17:
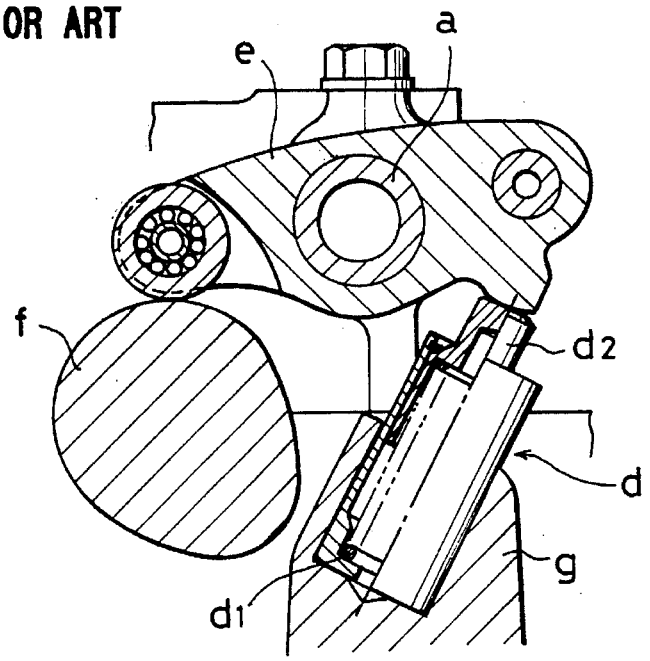
FIG.17 PRIOR ART
FIG. 17 s a sectional side view of another conventional example.

An embodying example shown in FIGS. 13 through 15 has the following arrangement. Namely, a pair of first and second driving rocker arms $\mathbf{41}_1$, $\mathbf{41}_2$ and a pair of first and second free rocker arms $\mathbf{42}_1$, $\mathbf{42}_2$ are alternately disposed. Each of the driving rocker arms $\mathbf{41}_1$, $\mathbf{41}_2$ is caused to contact the circular shaft portions of the valve driving cam 2. The first free rocker arm $\mathbf{42}_1$ is caused to contact the low-speed cam portion 2*a* of the valve driving cam 2 via a roller $\mathbf{42}_1b$. The second free rocker arm $\mathbf{42}_2$ is caused to abut the high-speed cam portion 2*b* of the valve driving cam 2 via a roller $\mathbf{42}_2b$. Further, there are provided a first changeover mechanism $\mathbf{43}_1$ for connecting the first driving rocker arm $\mathbf{41}_1$ and the first free rocker arm $\mathbf{42}_1$ and releasing the connection therebetween, a second changeover mechanism $\mathbf{43}_2$ for connecting the second driving rocker arm $\mathbf{41}_2$ and the second free rocker arm $\mathbf{42}_2$ and releasing the connection therebetween, a third changeover mechanism $\mathbf{43}_3$ for connecting the first and the second driving rocker arms $\mathbf{41}_1$, $\mathbf{41}_2$ and the second free rocker arm $\mathbf{42}_2$ and releasing the connection therebetween. It is thus arranged to be changed over among the following conditions: namely, a condition in which the first driving rocker arm $\mathbf{41}_1$ and the first free rocker arm $\mathbf{42}_1$ are connected by the first changeover mechanism $\mathbf{43}_1$, whereby only that one of the intake valves which corresponds to the first driving rocker arm $\mathbf{41}_1$ is opened and closed by the low-speed cam portion 2*a*; a condition in which the second driving rocker arm $\mathbf{41}_2$ and the second free rocker arm $\mathbf{42}_2$ are connected by the second changeover mechanism $\mathbf{43}_2$, whereby only the other of the inlet valves which corresponds to the second driving rocker arm $\mathbf{41}_2$ is opened and closed by the high-speed cam portion 2*b*; a condition in which the first driving rocker arm $\mathbf{41}_1$ and the first free rocker arm $\mathbf{42}_1$ are connected and the second driving rocker arm $\mathbf{41}_2$ and the second free rocker arm $\mathbf{42}_2$ are connected respectively by the first changeover mechanism $\mathbf{43}_1$ and the second changeover mechanism $\mathbf{43}_2$, whereby one of the inlet valves is opened and closed by the low-speed cam portion 2*a* and the other of the inlet valves is opened and closed by the high-speed cam portion 2*b*; a condition in which both the rocker arms $\mathbf{41}_1$, $\mathbf{41}_2$ are connected to the second free rocker arm $\mathbf{42}_2$ by the third changeover mechanism $\mathbf{43}_3$, whereby both the intake valves are opened and closed by the high-speed cam portion 2*b*; and a cylinder rest condition in which the connection between each of the driving rocker arms $\mathbf{41}_1$, $\mathbf{41}_2$ and the connection between each of the free rocker arms $\mathbf{42}_1$, $\mathbf{42}_2$ are all released, whereby the pair of intake vales are both kept closed.

Each of the first and the second changeover mechanisms $\mathbf{43}_1$, $\mathbf{43}_2$ is made up of: pistons $\mathbf{43}_1a$, $\mathbf{43}_2a$ which are respectively inserted into each of the first and the second free rocker arms $\mathbf{42}_1$, $\mathbf{42}_2$; connecting pins $\mathbf{43}_1b$, $\mathbf{43}_2b$ which can be respectively engaged between each of the free rocker arms $42_1$, $42_2$ and each of the first and the second driving rocker arms $41_1$, $41_2$; restricting pins $43_1d$, $43_2d$ *with springs* $43_1c$, $43_2c$, which pins and springs are respectively inserted into each of the driving rocker arms $41_1$, $42_2$; and oil chambers $43_1e$, $43_2e$ which are respectively formed in each of the free rocker arms $41_1$, $42_2$. Thus, when the oil pressure in the oil chambers $43_1e$, $43_2e$ is low, each of the free rocker arms $42_1$, $42_2$ and each of the driving rocker arms $41_1$, $42_2$ are respectively connected via the respective connecting pins $43_1b$, $42_2b$. When the oil pressure in the oil chambers $43_1e$, $43_2e$ increases, the connecting pins $43_1b$, $43_2b$ are respectively pushed into each of the driving rocker arms $41_1$, $42_2$, whereby the respective connection between each of the free rocker arms $42_1$, $42_2$ and each of the driving rocker arms $41_1$, $42_2$ is released.

The third changeover mechanism $43_3$ is made up of: a first connecting pin $43_3a$ which is inserted into the second driving rocker arm $41_2$; a second connecting pin $43_3b$ which is inserted into the second free rocker arm $42_2$; a restricting pin $43_3d$ with a spring $43_3c$, which pin and spring are inserted into the first driving rocker arm $41_1$; and an oil chamber $43_3e$ which is formed in the second driving rocker arm $41_2$. When the oil pressure in the oil chamber $43_3e$ is increased, the first connecting pin $43_3a$ is engaged with the second free rocker arm $42_2$, and also the second connecting pin $43_3b$ is engaged with the first driving rocker arm $41_1$, whereby both the driving rocker arms $41_1$, $41_2$ and the second free rocker arm $42_2$ are connected.

The second free rocker arm $42_2$ is fixed to the rocker arm shaft 44. The bar-like torsion spring 45 which serves as the urging means for the second free rocker arm 422 is inserted into the rocker arm shaft 44. Both ends and the intermediate portion of the torsion spring 45 are respectively mounted in a nonrotatable manner on the cam holders 7, 7 and the rocker arm shaft 44 at the serrated portions 45*a*. The intermediate serrated portion 45*a* coincides with the portion in which the second free rocker arm $42_2$ is disposed. The rocker arm shaft 44 is divided inside thereof into two chambers, i.e., one chamber and the other chamber in the axial direction partitioned by the serrated portion 45*a* by means of the connecting portion between the rocker arm shaft 44 and the torsion spring 45. In the torsion spring 45 there is formed an axially extending oil bore 45*b*. It is thus so arranged that oil can be supplied in the following manner, i.e.,: from the first oil passage $43f_1$ formed in one of the cam holders 7 to the oil chamber $43_1e$ of the first changeover mechanism $43_1$ via one of the chambers of the rocker arm shaft 44; from the second oil passage $43f_2$ formed in the other of the cam holders 7 to the oil chamber $43_2e$ of the second changeover mechanism $43_2$ via the oil bore 45*b* and part through the serrated portion 45*a*; and from the third oil passage $43f_3$ formed in the other of the cam holders 7 to the oil chamber $43_3e$ of the third changeover mechanism $43_3$ via the other of the chambers of the rocker arm shaft 44.

In this manner, by utilizing the torsion spring 45 commonly as a piping element for the changeover mechanisms and further as a partition material inside the rocker arm shaft 44, it becomes possible to change over the valve lift amount and the timing of opening and closing the valves in multiple stages. Further, when the intermediate portion of the torsion spring 45 is connected to the rocker arm shaft 44 by friction welding or the like, the oil can be supplied from the oil bore 45*b* of the torsion spring 45 to the oil chamber $43_2e$ of the second changeover mechanism 432 through a port in the intermediate connecting portion.

By the way, in case two free rocker arms $42_1$, $42_2$ are provided as described above, it will be difficult to dispose inside the rocker arm shaft 44 two urging means for the two free rocker arms. Therefore, in the above-described embodying example, the urging means 45 for the second free rocker arm $42_2$ is disposed inside the rocker arm shaft 44 and the conventional type of the urging means 46 for the first free rocker arm $42_1$ is mounted, as shown in FIG. 15, on the boss portion l*a* which is provided in a projecting manner on the cylinder head 1.

Explanations have so far been made about the rocker arm unit 4 for the intake valves. It is needless to say that the present invention can also be applied to the rocker arm unit for the exhaust valves.

As can be seen from the above-described explanations, according to the present invention, it is not necessary to provide a space, outside the rocker arm unit, for disposing therein the urging means for the free rocker arm. Therefore, the valve operating apparatus can be constituted in a compact manner, so that the height of the internal combustion engine can be reduced and the freedom of design in the layout of the valves can be increased. Further, since the external mounting member to be used exclusively for the urging means and the urging means of complicated construction become unnecessary, the valve operating apparatus can be made lighter in weight and smaller in manufacturing cost.

Furthermore, by disposing the urging means inside the rocker arm shaft, the rocker arm can be sub-assembled in a condition in which the urging means has been assembled therein. The workability or the ease with which the valve operating apparatus is assembled can thus be improved.

It is readily apparent that the above-described valve operating apparatus for driving an intake valve and an exhaust valve of an internal combustion engine meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A valve operating apparatus for driving an intake valve or an exhaust valve of an internal combustion engine, said valve operating apparatus having a valve operating cam and a rocker arm unit, said rocker arm unit comprising:

a driving rocker arm which operatively contacts the valve;

a free rocker arm which is free from operative contact with the valve; and a changeover mechanism for varying a valve lift amount and timing of opening and closing the valve by connecting said rocker arms and releasing the connection therebetween;

said free rocker arm being urged by urging means so as to operatively contact said valve operating cam;

wherein said urging means is disposed inside a hollow rocker arm shaft of said rocker arm unit.

2. A valve operating apparatus according to claim 1, wherein said free rocker arm is fixed to said rocker arm shaft, and wherein said urging means is a torsion spring which is connected to said rocker arm shaft.

3. A valve operating apparatus according to claim 2, wherein said torsion spring is a torsion bar spring, and wherein said torsion bar spring is engaged with an internal circumference of said rocker arm shaft in a fluid tight relationship at a connecting portion where said torsion bar spring is connected to said rocker arm shaft such that a working fluid is supplied to said changeover mechanism via a chamber defined at least by said torsion bar, said hollow rocker arm shaft, and said connecting portion.

4. A valve operating apparatus according to claim 2, wherein said torsion spring is a torsion bar spring, wherein said torsion bar spring is engaged with an internal circumference of said rocker arm shaft in a fluid tight relationship at a connecting portion where said torsion bar spring is connected to said rocker arm shaft, and wherein said torsion bar spring also serves a purpose of a piping element for supplying a working fluid to said changeover mechanism.

5. A valve operating apparatus according to claim 1, wherein said free rocker arm is rotatably supported on said rocker arm shaft, and wherein said urging means is a torsion spring which is connected to said free rocker arm through a radial opening formed in said rocker arm shaft.

6. A valve operating apparatus for an internal combustion engine for driving an intake valve or an exhaust valve from a valve operating cam through a rocker arm unit including a driving rocker arm operatively contacting the valve; a free rocker arm free from operative contact with the valve; said driving rocker arm and free rocker arm mounted on a rocker arm shaft supported by supporting means; and a changeover mechanism for varying a valve lift amount and timing of opening and closing the valve by connecting said rocker arms and releasing the connection therebetween; an improvement comprising:

urging means mounted inside the rocker arm shaft for urging the free rocker arm into operative contact with the valve operating cam.

7. A valve operating apparatus according to claim 7, wherein the rocker arm shaft is hollow and said urging means is a torsion spring mounted inside the hollow rocker arm shaft.

8. A valve operating apparatus according to claim 6, wherein the free rocker arm is rotatably supported on the rocker arm shaft, and wherein the rocker arm shaft is hollow and said urging means is positioned inside the hollow rocker arm shaft and connected to the free rocker arm through a radial opening formed in the rocker arm shaft.

* * * * *